United States Patent [19]

Nakanishi

[11] Patent Number: 4,588,182

[45] Date of Patent: May 13, 1986

[54] PAPER FEEDING APPARATUS

[75] Inventor: Tomoyuki Nakanishi, Moriyama, Japan

[73] Assignee: Omron Tateisi Electronics Co., Kyoto, Japan

[21] Appl. No.: 597,374

[22] Filed: Apr. 6, 1984

[30] Foreign Application Priority Data

Apr. 6, 1983 [JP] Japan ..... 58-51295[U]

[51] Int. Cl.[4] ..... B65H 3/52

[52] U.S. Cl. ..... 271/121; 271/149

[58] Field of Search ..... 271/121, 124, 125, 149, 271/160

[56] References Cited

U.S. PATENT DOCUMENTS 2,670,954 3/1954 Bach ..... 271/124 X
2,705,636 4/1955 La Bombard ..... 271/124
3,958,800 5/1976 Gates ..... 271/149 X
4,474,365 10/1984 DiBlasio ..... 271/315 X

FOREIGN PATENT DOCUMENTS 2332034 1/1975 Fed. Rep. of Germany ..... 271/124

*Primary Examiner*—Richard A. Schacher
*Attorney, Agent, or Firm*—Stevens, Davis, Miller & Mosher

[57] ABSTRACT

A paper feeding apparatus feeds one sheet of stacked papers contained in a cassette box by a feeding roller supported rotatably on a frame of a body and passes the one sheet through a clearance provided between a guide element and an outer periphery of the feeding roller; structures are provided for maintaining the clearance fixed even when the feeding roller wears down so as to surely pass one sheet of paper through the clearance without regard to the degree of wearing of the feeding roller.

3 Claims, 1 Drawing Figure

PAPER FEEDING APPARATUS

BACKGROUND OF THE INVENTION

This invention relates to a paper feeding apparatus applied to a feeding portion where bank notes are fed, in machines, for example, such as an automatic cash dispenser, an automatic money exchanger and the like.

In the past, an apparatus for feeding stacked papers sheet by sheet has a construction wherein the stacked papers are pressed against the front peripheral surface of a feeding roller, pulled into a clearance between the roller and a guide element, and discharged into an outlet located at the rear of the roller. However, since the feeding roller is formed of a material of high coefficient of friction because the roller pulls in and conveys the papers by aid of a frictional force thereof, there is a possibility that the feeding roller becomes worn early thereby increasing the clearance between the roller and the guide element, as a consequence of which papers are discharged by two sheets at a time or the papers become clogged. Therefore, it is necessary to make a fine adjustment of the clearance at short intervals.

To eliminate such adjustment, a proposal has been made of a feeding apparatus having a construction in which a guide element is lightly pressed against a feeding roller. However, such an apparatus has many disadvantages in that the feeding roller and the guide element become worn out, an error in the pulling operation of papers occurs, and the like.

SUMMARY OF THE INVENTION

It is an object of this invention to provide a new paper feeding apparatus in which a guide element is displaced towards a feeding roller according to wearing of the feeding roller to thereby always form and maintain a given pull-in clearance between the roller and the guide element for smooth feeding operation.

In accordance with the present invention, a swinging arm is pivotally displaced according to the wearing of the feeding roller to maintain a given clearance between the feeding roller and the guide element.

DETAILED DESCRIPTION OF THE INVENTION

Figure 1:
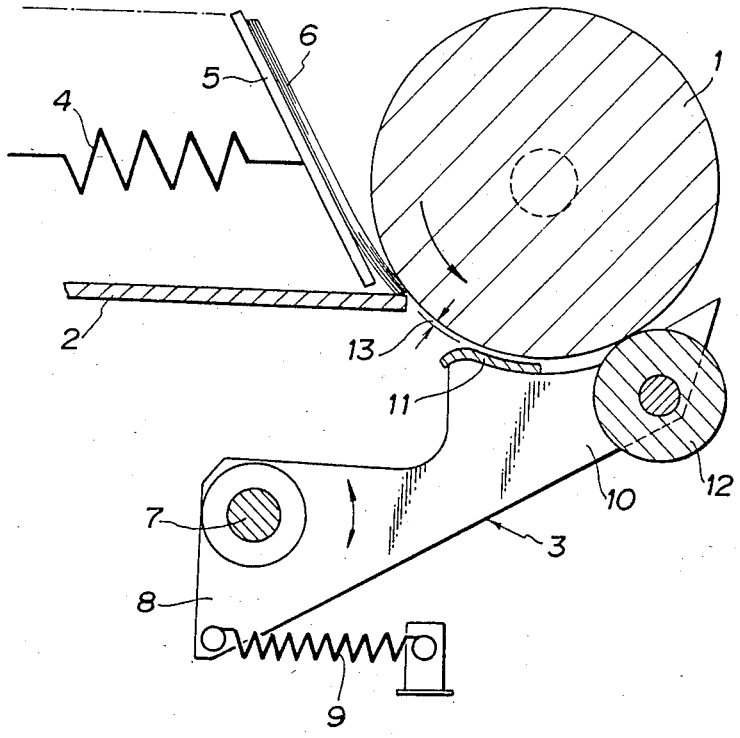
FIG. 1 is a schematic side sectional view showing a paper feeding apparatus in accordance with one embodiment of this invention.

FIG. 1 shows a schematic construction of a paper feeding apparatus in accordance with one embodiment of this invention.

This paper feeding apparatus is composed of a feeding roller 1 rotatively supported on a side wall of a body, a cassette box 2 disposed on one side nearly horizontal to the feeding roller 1, and a swinging arm 3 disposed below the feeding roller 1.

The cassette box 2 is provided with a push plate 5 which is biased towards an outlet by means of a spring 4.

Stacked papers 6 are positioned on the outlet side of the cassette box 2 nearly upright while being supported by the push plate 5, and are biased by the push plate 5 with the foremost paper abutting against the feeding roller 1.

The feeding roller 1 is formed of a rubber material and is rotating in a direction as indicated by the arrow so that the foremost one of the stacked papers 6 may be drawn and forced downwardly.

The swinging arm 3 is pivotally supported on a shaft 7 projected from the side all of the body below the cassette box 2. A driving end 8 below the shaft 7 is pulled by a spring 9 and a swinging end 10 is biased towards the lower peripheral surface of the feeding roller 1. On the end surface of the swinging end 10 opposed to the lower peripheral surface of the feeding roller 1 is attached a guide element 11 formed of rubber material at a position in proximary of an outlet side of the cassette box 2. A guide roller 12 is rotatively supported at the end side of the swinging end 10 and is biased by the spring 4 into abutment with the lower peripheral surface of the feeding roller 1. Thereby, between the guide element 11 and the lower peripheral surface of the feeding roller 1 is formed a clearance 13 of a fixed width corresponding to a thickness of a sheet of paper. The shaft 7 may be moved up and down so as to facilitate work for determining the width of the clearance 13.

With the construction as described above, the foremost paper of the stacked papers 6 is drawn towards the clearance by surface friction of the rotating feeding roller 1, passes through the clearance 13 and is discharged into an outlet (not shown) provided on the other side of the feeding roler 1.

By repetition of the feeding operation as described above, the feeding roller 1 gradually wears out but the swinging end 10 is pivotally displaced according to the degree of said wearing. As a consequence, the clearance is always maintained to be fixed width.

What is claimed is:

1. A paper feeding apparatus comprising:

a cassette box containing stacked papers;

a feeding roller supported rotatably on a frame of a body for feeding one sheet of said stacked papers from said cassette box by surface friction;

a swinging arm supported pivotally on said frame of said body;

a guide element fixed on a surface of said swinging arm and in a position opposing to said feeding roller;

a guide roller supported rotatably on said swinging arm at a location spaced from said surface; and means for biassing said swinging arm so that said guide roller abuts against a peripheral surface of said feeding roller, the abutment of said guide roller against the surface of said feeding roller defining a positioning of said swinging arm to provide a fixed clearance between said feeding roller and said guide element which is maintained as said feeding roller wears.

2. A paper feeding apparatus according to claim 1, wherein said stacked papers are arranged to be nearly upright in said cassette box, said apparatus further comprising means for biassing said stacked papers so that a foremost one abuts against a periphral surface of said feeding roller, said cassette box and feeding roller being disposed in a horizontal direction.

3. A paper feeding apparatus according to claim 1 wherein a foremost one of said stacked papers is abutted against an upper periphery of said feeding roller so that said cassette box is disposed over said feeding roller.

* * * * *